United States Patent [19]

Hida

[11] Patent Number: 4,484,455

[45] Date of Patent: Nov. 27, 1984

[54] CUTTER FOR AN AUGER TYPE ICEMAKER

[75] Inventor: Junichi Hida, Chiryu, Japan

[73] Assignee: Hoshizaki Electric Co., Ltd., Aichi, Japan

[21] Appl. No.: 458,050

[22] Filed: Jan. 14, 1983

[51] Int. Cl.[3] ..... F25C 5/12

[52] U.S. Cl. ..... 62/320; 62/354; 241/DIG. 17

[58] Field of Search ..... 62/320, 354; 241/DIG. 17, 186 A, 186 R, 82.5

[56] References Cited

U.S. PATENT DOCUMENTS

| | | | |
|---|---|---|---|
| 1,212,915 | 1/1917 | Daughtry | 241/DIG. 17 |
| 3,126,719 | 3/1964 | Swatsick | 62/320 |
| 3,196,624 | 7/1965 | Reynolds . | |
| 3,196,628 | 7/1965 | Reynolds | 62/320 X |
| 3,372,558 | 3/1968 | Guard | 62/320 |
| 3,593,539 | 7/1971 | Fiedler | 62/320 X |
| 3,662,564 | 5/1972 | Clearman et al. | 62/320 |
| 4,198,831 | 4/1980 | Barnard et al. | 62/320 |

*Primary Examiner*—William E. Tapolcai

*Attorney, Agent, or Firm*—Wenderoth, Lind & Ponack

[57] ABSTRACT

A cutter for an auger type icemaker including an auger shaft with an auger edge to scrape and guide upward the ice formed on the inner surface of a refrigerated casing, an extrusion head fitted to the upper end portion of the auger shaft and provided with ice compressing passages, and a cutter attached to the upper end of the auger shaft over the extrusion head for breaking the ice from the ice compressing passages. A positioning portion is disposed on the upper end of the auger shaft to position the cutter at a predetermined circumferential location. The cutter is provided with a cutter edge supporting portion with an attaching portion which is attached to the positioning portion and which can change the positioning location of the cutter in cooperation with the positioning portion. The cutter is also provided with a plurality of cutter edges which are inclined in relation to the horizontal plane of the cutter edge supporting portion and which are fixed to the cutter edge supporting portion therearound at various pitches according to the various positioning locations. An angle of relief is disposed at each lower end of the cutter edges to release the ice upward.

19 Claims, 13 Drawing Figures

CUTTER FOR AN AUGER TYPE ICEMAKER

BACKGROUND OF THE INVENTION

The present invention relates to a cutter for cutting the pillar shaped ice discharged from the ice compressing passages in an auger type icemaker.

In the conventional auger type icemaker, to change the ice formed within a refrigerated casing and scraped by an auger edge into ice flakes of different grains and hardnesses, it is necessary that a cutter attached to the upper surface of the auger shaft over an extrusion head disposed in the upper portion of the refrigerated casing is exchanged for another cutter differing in shape from the one in the former cutter, or the ice discharging path is changed. Accordingly, it is not easy to obtain ice flakes of different grains and hardnesses in the conventional icemaker.

SUMMARY OF THE INVENTION

A cutter for an auger type icemaker according to the present invention comprises an auger shaft with an auger edge rotatably supported within a refrigerated casing to scrape and guide upward the ice formed on the inner surface of the refrigerated casing, an extrusion head fitted to the upper end portion of the auger shaft and provided with ice compressing passages receiving the ice from the auger edge, and a cutter attached to the upper end of the auger shaft over the extrusion head and breaking the ice from the ice compressing passages.

A positioning means is disposed on the upper end of the auger shaft to position the cutter at a predetermined circumferential location. The cutter is provided with a cutter edge supporting portion with an attaching means which is attached to the positioning means and which can change the positioning location of the cutter in cooperation with the positioning means. The cutter is also provided with a plurality of cutter edges (blades) which are inclined to the horizontal plane of the cutter edge supporting portion and which are fixed to the cutter edge supporting portion therearound at various pitches according to the various positioning locations. The lower ends of the cutter edges have angles of relief so as to release the ice upward.

It is the principal object of the present invention to provide a cutter for an auger type icemaker which can easily obtain ice of different grains.

Another object of the present invention is to provide a cutter for an auger type icemaker which can easily obtain ice of different hardnesses.

Further objects and advantages of the invention will be apparent with reference to the following specification and drawings.

DESCRIPTION OF THE PREFERRED EMBODIMENTS

Figure 1:
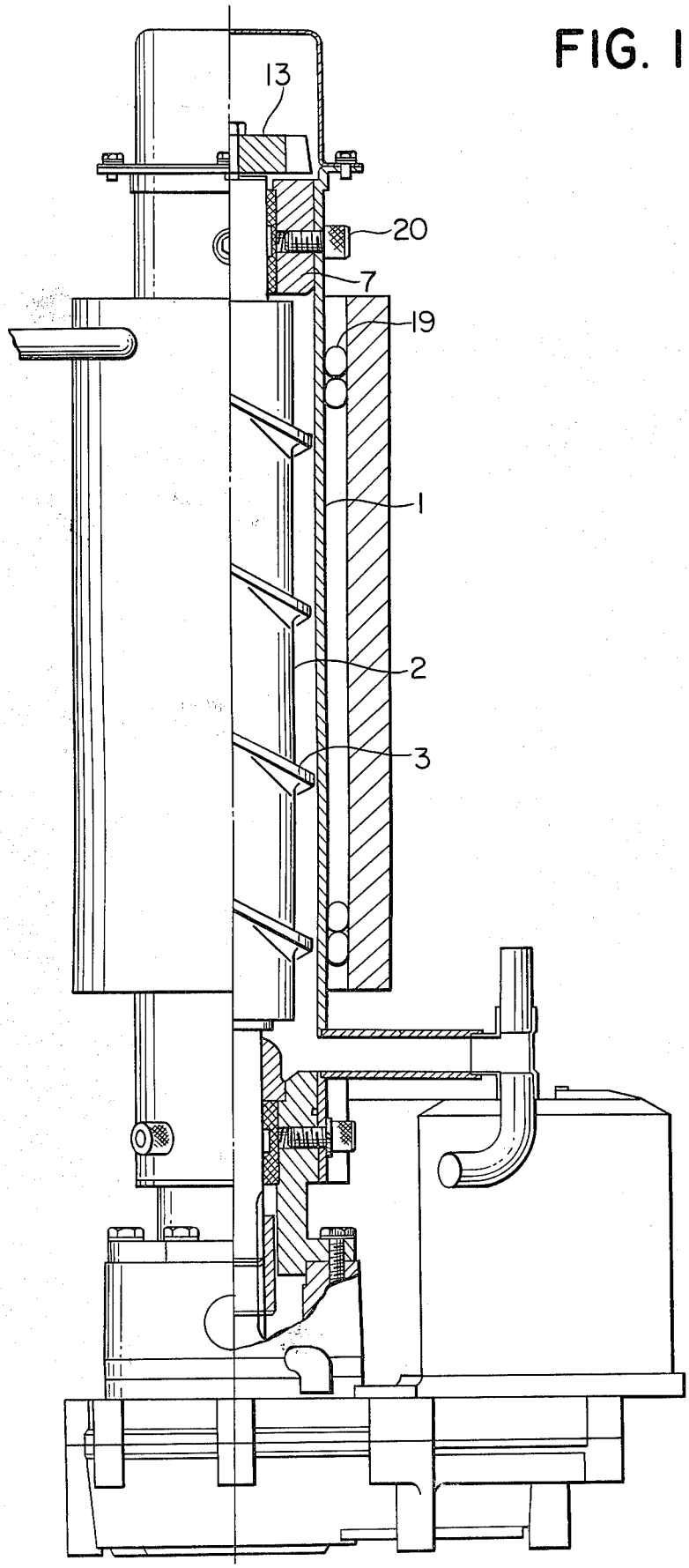
FIG. 1 is a sectional view of a portion near a refrigerated casing of an auger type icemaker.
Figure 2:
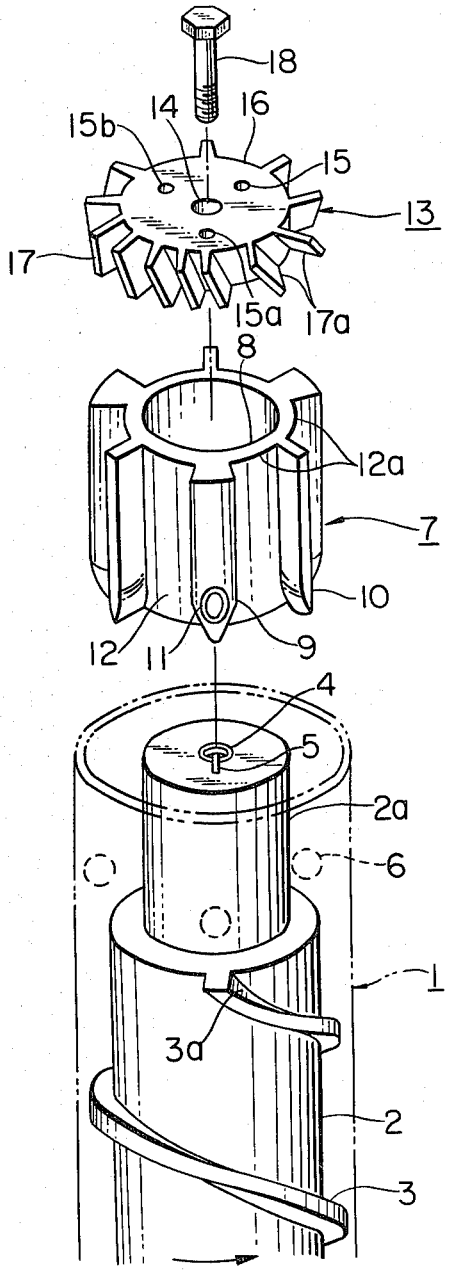
FIG. 2 is an exploded view showing a constitution within the refrigerated casing containing a cutter according to the present invention.

FIGS. 1 and 2 show the structure within a refrigerated casing including the present cutter for an auger type icemaker. A cooling pipe (evaporator) 19 is disposed on the outer circumference of the refrigerated casing 1 so as to form a thin ice layer on the inner wall surface of the refrigerated casing. An auger shaft 2 with an auger edge 3 is rotatably supported in the refrigerated casing 1 to scrape and guide upward the thin ice layer. A small diameter portion **2*a* at the upper end of the auger shaft 2 has a diameter smaller than the other parts of the auger shaft 2 to fit an extrusion head 7 for guiding upward and compressing the ice from the auger edge 3. On the uppermost end surface of the small diameter portion 2*a*, a tapped hole 4 for receiving a bolt 18 is disposed to screw a cutter 13 which is attached onto the extrusion head 7 to the auger shaft 2, and a pin 5 is disposed to position the cutter 13 onto the extension of the circumferential position of the auger shaft 2. The pin 5 is used to align the cutter 13 with the uppermost end of the auger edge in the axial direction and to define the relative position between the cutter 13 and the upper end of the auger edge 3*a*. Three openings 6 are disposed in the wall of the refrigerated casing 1 to secure the extrusion head 7** into the refrigerated casing.

The extrusion head 7 is provided with a cylindrical portion 8 fitted to the small diameter portion **2*a* of the auger shaft 2 and with three thick and thin bosses 9, 10 fixed to the cylindrical portion 8 therearound. Each thick boss 9 is provided with a tapped hole 11 for receiving a bolt 20 through the corresponding opening 6 to secure the extrusion head 7 to the refrigerated casing 1. Each passage 12 between the thick bosses 9 and the thin bosses 10** comprise an ice compressing passage for compressing the ice within the passage and extracting the water therefrom while the ice is guided upward.

The cutter 13 on the extrusion head 7 is provided with a cutter edge supporting portion 16 and a plurality of cutter edges (blades) 17. The cutter edge supporting portion 16 has a through hole 14 for receiving the bolt 18 to secure the cutter to the small diameter portion **2*a* of the auger shaft 2, and a plurality of pin receiving holes 15 (three holes in FIG. 2) for fitting the pin 5 of the small diameter portion 2*a*. The cutter edges 17 are integrally fixed to the cutter edge supporting portion therearound and inclined at an equivalent angle (60 degrees in FIG. 2) to the horizontal surface of the cutter edge supporting portion. The cutter 13 thus rotates together with the auger shaft 2**.

According to the above constitution, the extrusion head 7 is fitted to the small diameter portion **2*a* of the auger shaft 2 and secured to the refrigerated cylinder 1 after the insertion of each bolt 20 to the corresponding opening 6 of the refrigerated casing 1. The cutter 13** can be thus secured to the auger shaft upper end over the extrusion head 7 after the insertion of the pin 5 and the bolt 18 in their respective holes in the cutter.

Figure 3:
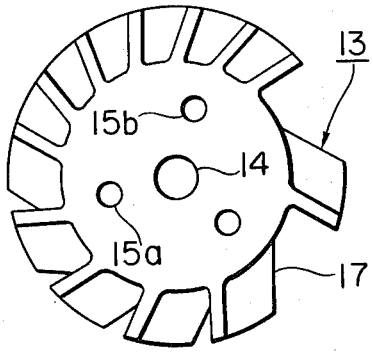
FIG. 3 is a plan view of the cutter shown in FIG. 2.
Figure 4:
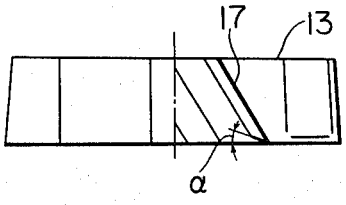
FIG. 4 is a partially schematical front view of the cutter in FIG. 3.

FIGS. 3 and 4 are respectively plan and front views of the cutter 13. As understood from these figures, an angle $\alpha$ of relief for releasing the ice upward is disposed at each lower end of the inclined cutter edges 17. The angle $\alpha$ of relief is about 15 degrees as shown in the enlarged view FIG. 5. Ice of different hardnesses can be obtained by suitably changing the angle $\alpha$ of relief since the ice pushed upward from the ice compressing passages 12 of the extrusion head 7 is either pressed by the cutter edge or goes upward. Furthermore, as understood from FIGS. 1 to 4, the rate of breaking the pillar shaped ice from the ice compressing passages 12 can be changed if the pitch of the cutter edges 17, i.e. the number of edges per unit length, or otherwise stated, the number of edges per unit angle about the axis of rotation, is changed.

The action of the cutter according to the present invention will now be explained.

A thin ice layer is formed by the cooling pipe 19 on the inner wall of the refrigerated casing 1 and is scraped by the rotating auger edge 3 and is guided upward within the casing into the ice compressing passages 12 formed by the thick and thin bosses 9, 10 of the extrusion head 7. The scraped ice entering the ice compressing passages 12 is compressed and the water is extracted therefrom while the ice is guided upward, by the scraped ice being pushed upward from the auger edge through the rotation of the auger shaft. Thus, the ice exiting from the ice compressing passages 12 is changed into pillar shaped ice. Each pillar of ice from the ice compressing passages 12 is cut by cutter edges 17, since the cutter 13 is fixed to the upper end of the auger shaft 2 by the bolt 18 and the pin 5 of the auger shaft so as to rotate the cutter together with the auger shaft 2.

Each pillar of ice is pushed upward by turns from the ice compressing passages 12 as the upper end 3*a* of the auger edge rotates. Namely, as the auger rotates as shown in the arrow in FIG. 2, the compressed pillar of ice in one of the ice compressing passages 12 right above the upper end 3*a* of the auger edge is pushed upward from the ice compressing passage 12 and cut by the cutter edge 17. As the auger shaft 2 rotates the ice compressing passages positioned right above the upper end 3*a* change so that each of the six ice compressing passages 12 becomes, by turns of the auger shaft 2, the ice compressing passage positioned directly above the upper end 3*a* of the auger edge.

A pillar of ice is thus pushed upward by turns from each of the six ice compressing passages 12. Since the cutter 13 is fixed to the upper end of the auger shaft 2 to rotate together with the auger shaft, in the case of the rotating position of the auger shaft shown in FIG. 2, the pillars of ice from the ice compressing passages 12 are cut by two cutter edges 17*a* within the extension of approximately two ice compressing passages 12*a* which are positioned right above the upper end 3*a* of the auger edge and on the right side of the pin receiving hole 15*a* fitting the pin 5. This is the reason why a circumferential portion of the extrusion head 7 where the ice is pushed upward from the ice compressing passages 12 is about $\frac{1}{3}\sim 174$ of the entire circumference of the extrusion head 7 towards the rotating direction of the auger shaft 2 from the lower end portion of the extrusion head 7 in proximity to the uppermost end of the auger edge 3, so that the pillar shaped ice is successively pushed upward from approximately two ice compressing passages which are to be passages 12*a* in the auger position shown in FIG. 2. The two ice compressing passages are cyclically changed by the rotation of the auger shaft. The ice can be adjusted in granular size, depending upon the number of cutter edges 17 within the extension of the approximately two ice compressing passages 12. Hence, the ice grain becomes small by the increase of the rate of breaking the pillars of ice in the case of a large number of cutter edges, and becomes large in the case of a small number thereof.

Accordingly, ice flakes of large grain can be obtained when as shown in FIG. 2, two cutter edges 17*a* are used to cut the pillars of ice, where the pin 5 of the auger shaft 2 is fitted into the pin receiving hole 15*a* of the cutter 13. Alternatively, when the pin 5 is fitted into the pin receiving hole 15*b*, ice flakes of small grain can be obtained by the large number of cutter edges within the extension of two ice compressing passages, since many cutter edges 17 are positioned on the right side of the pin receiving hole 15*b*. It is thus understood from the above that the granular size of the ice flakes can be changed by changing the number of cutter edges to the right side of the extension of the upper end 3*a* of the auger edge (or of the pin 5 in the axial direction of the auger shaft).

Figure 5:
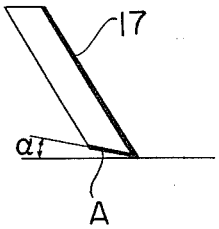
FIG. 5 is an enlarged view of the cutter edge in FIG. 4.

Furthermore, as shown in FIG. 5, hardness in ice flakes can be adjusted by changing the angle $\alpha$ of relief of the cutter edge 17. Namely, when the angle $\alpha$ of relief is small or zero, hard ice flakes can be obtained since a portion of the pillar of ice pushed upward from each ice compressing passage 12 is pushed and even compressed by contact with the bottom A of the cutter edge 17. Conversely, when the angle $\alpha$ of relief is large, soft ice flakes can be obtained since the piller shaped ice goes upward along the bottom A defining the angle $\alpha$ of relief immediately after it has passed the lowermost end of the cutter edge 17.

Figure 6:
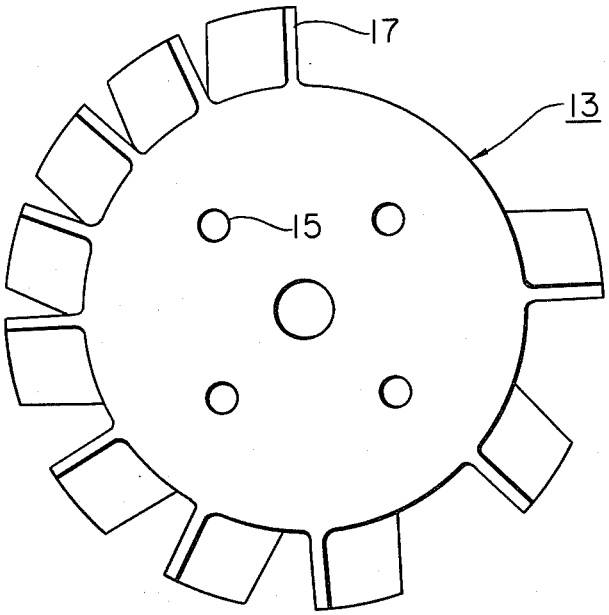
FIG. 6 is a plan view showing another embodiment of the cutter according to the present invention.

FIG. 6 shows another embodiment of the cutter according to the present invention, where the cutter has four pin receiving holes 15, differing from the cutter in FIGS. 2 to 4. The adjustable range of granular size in ice flakes is widened by increasing the number of pin receiving holes 15 and/or the number of cutter edges. As shown in FIG. 6, when the diameter of the auger shaft 2 is large and the extrusion head 7 or the ice compressing passages 12 are not so high, as in the case of a large auger type icemaker, the number of adjustable portions can be increased since the numbers of cutter edges and pin receiving holes in the cutter are increased.

Figure 7:
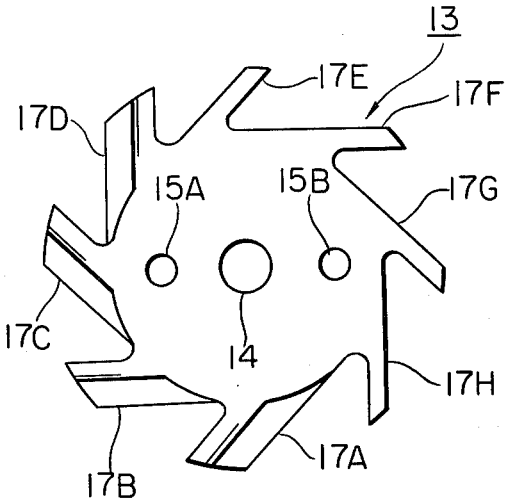
FIG. 7 is a plan view showing a further embodiment of the cutter according to the present invention.
Figure 8:
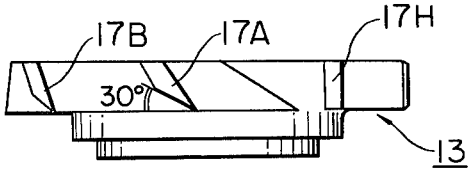
FIG. 8 is a front view of the cutter in FIG. 7.
Figure 9:
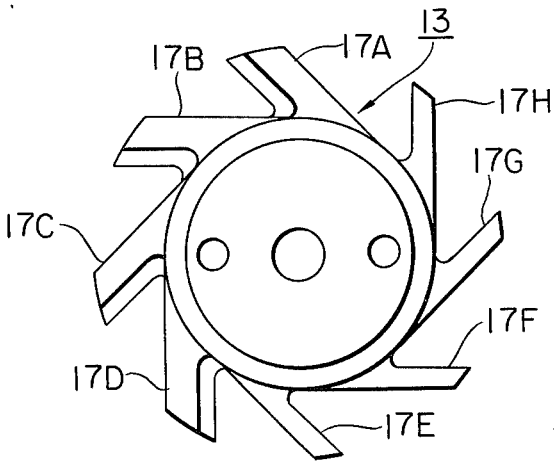
FIG. 9 is a bottom view of the cutter in FIG. 7.

FIGS. 7 to 9 show a further embodiment of the present cutter. The cutter is provided with eight cutter edges and two pin receiving holes. As shown in the front view of FIG. 8, the angle $\alpha$ of relief is 30° at each lower end of four cutter edges 17A to 17D, and 0° at each lower end of the remaining four cutter edge 17E to 17H. The cutter edges 17A to 17H are fixed to the cutter edge supporting portion equiangularly, i.e., at an equivalent pitch around the through hole 14, and respectively have a 60° inclined angle to the horizontal plane of the cutter edge supporting portion. Since a plurality of cutter edges with different angles $\alpha$ of relief are fixed to the cutter edge supporting portion in the above cutter 13, the ice from the ice compressing passages 12 is cut by cutter edges 17A to 17C when the pin 5 is fitted into the pin receiving hole 15A and by cutter edges 17E to 17G when the pin 5 is fitted into the pin receiving hole 15B. In the case of cutter edges 17A to 17C with the angle 30° of relief at each lower end thereof, relatively soft ice can be obtained since the ice tends to go upward along the bottom of each cutter edge. Alternatively, in the case of cutter edges 17E to 17G with the angle 0° of relief at each lower end thereof, relatively hard ice can be obtained since the ice does not easily go upward along the bottom of each cutter edge. Therefore, it is apparent from the above and FIGS. 3 through 9 that the cutter can comprise a cutter edge supporting portion with a plurality of in receiving holes, and a plurality of cutter edges with different angles of relief at each lower end thereof which are fixed to the supporting portion therearound at various pitches corresponding to the pin receiving holes.

Figure 10:
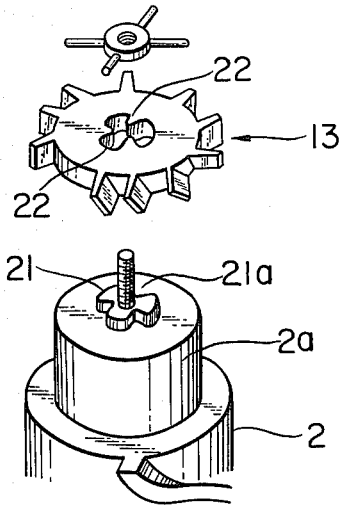
FIGS. 10 to 12 are perspective views showing other embodiments of the means for fixing the cutter to the auger shaft.
Figure 11:
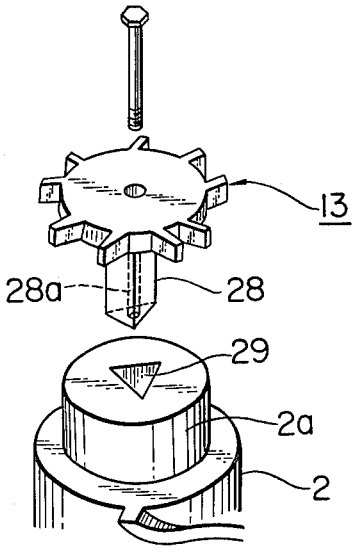
Figure 12:
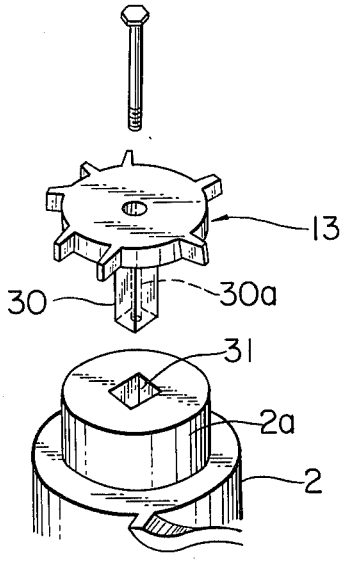

In the above embodiments, a pin is used as a means for fixing the cutter to the auger shaft. However other fixing means may be used such as keys, screws, a projection 21 and the corresponding hole 22 fitted to each other which have three concave portions 21*a* and the corresponding three convex portions 22*a*, respectively as shown in FIG. 10, a triangular prism 28 with a bolt through hole 28*a* fixed to the cutter 13 and a triangular hole 29 for receiving the prism 28 as shown in FIG. 11, a square pillar 30 with a bolt through hole 30*a* and a square hole 31 for receiving the pillar 30 as shown in FIG. 12, or a polygonal pillar and a corresponding polygonal hole which are not shown.

Figure 13:
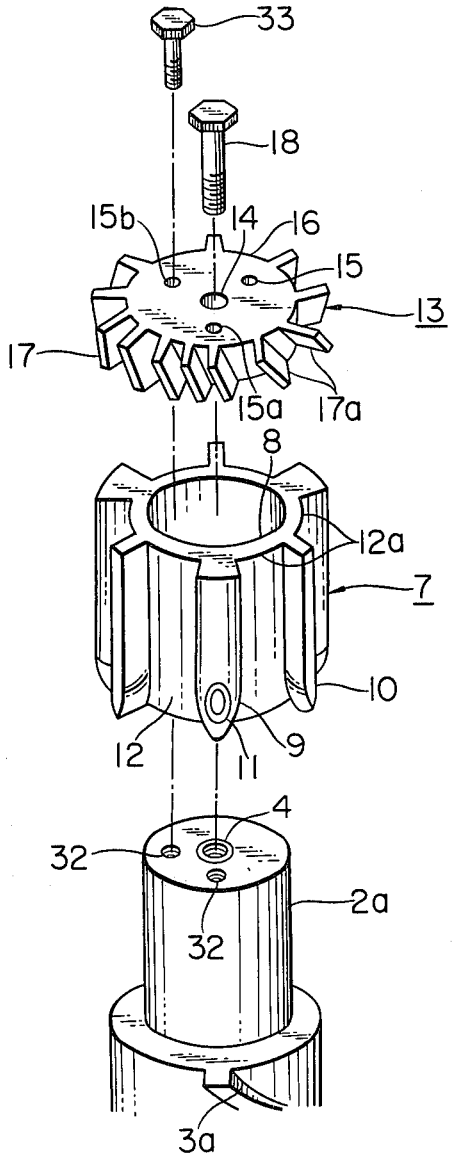
FIG. 13 is a perspective view showing a further embodiment of the means for fixing the cutter to the auger shaft.

A means shown in FIG. 13 may be used as a further embodiment of the fixing means. In this embodiment, a plurality of tapped holes (two holes in FIG. 13) 32 for a bolt 33 are disposed at the upper end of the small diameter portion 2*a* of the auger shaft. Accordingly, the cutter 13 is reliably secured to the upper end of the small diameter portion 2*a* by screwing the bolt 18 into the tapped hole 4 through the through hole 14 and screwing the bolt 33 into one of the tapped holes 32 through one of the through receiving holes 15.

In the above embodiments, the pin 5, the projection 21, the triangular prism 29, the square hole 31 and the tapped hole 32 respectively comprise a positioning means, and the through receiving hole 15, the hole 22 for the projection, the triangular prism 28 and the square pillar 30 respectively comprise an attaching means.

As stated above, a cutter according to the present invention is provided with a cutter edge supporting portion with an attaching means which is attached to a positioning means disposed at the upper end of the auger shaft and which can change the positioning location of the cutter in cooperation with the positioning means, and provided with a plurality of inclined cutter edges fixed to the cutter edge supporting portion therearound at different pitches corresponding to the positioning locations. Accordingly, ice flakes of different grains can be easily obtained by only changing the circumferential positioning location of the cutter instead of exchanging the cutter. Furthermore, when different angles of relief are disposed at the lower ends of the plurality of cutter edges, ice flakes of different hardnesses can be easily obtained by only changing the positioning location. Since the cutter edges are inclined, the ice is smoothly discharged so that a blockage of the ice within the refrigerated casing is effectively prevented.

What is claimed is:

1. An auger type icemaker comprising:

a refrigerated casing;

a vertically extending auger shaft with an auger edge, rotatably supported for rotation about a vertical axis of rotation within said refrigerated casing to scrape and guide upward ice formed on the inner surface of said refrigerated casing;

an extrusion head fitted to the upper portion of said auger shaft and provided with ice compressing passages for receiving the ice from said auger edge; and a cutter attached to said upper end of said auger shaft over said extrusion head so as to rotate in a horizontal plane about said axis of rotation for breaking the ice from the ice compressing passages;

said cutter including a cutter edge supporting portion, and at least three cutter edges spaced around said axis of rotation fixed to said cutter edge supporting portion at the periphery thereof, the number of said at least three cutter edges per unit angle about said axis of rotation varying around said axis of rotation, said plurality of cutter edges being inclined with respect to said plane;

the upper end of said auger shaft and said cutter edge supporting portion including cooperating means for positioning said cutter at any of a plurality of angular positions with respect to said axis of rotation so as to adjustably position said plurality of cutter edges in relation to said auger edge.

2. An icemaker as in claim 1, wherein said cutter edges have angles of relief at the lower ends thereof so as to release the ice upward.

3. An icemaker as in claim 2, wherein said cutter edges are inclined at 60° in relation to said horizontal plane.

4. An icemaker as in claim 2, wherein said cutter edges are inclined at 60° in relation to said horizontal plane.

5. An icemaker as in claim 2, wherein said angle of relief is about 15°.

6. An icemaker as in claim 2, wherein said cutter edges comprise eight cutter edges, wherein four of said eight cutter edges have an angle of relief of about 30° and the remaining four of said eight cutter edges have an angle of relief of about 0°.

7. An icemaker as in claim 1, wherein said positioning means includes at least one hole formed in one of said upper end of said auger shaft and said cutter edge supporting portion, and an elongated member fittable in said at least one hole, located on the other of said upper end of said auger shaft and said cutter edge supporting portion.

8. An icemaker as in claim 1, wherein said at least one hole comprises a plurality of holes spaced about said axis in said cutter edge supporting portion.

9. An icemaker as in claim 1, wherein said positioning means includes a plurality of through holes formed through said cutter edge supporting portion, a plurality of receiving holes formed in said upper end of said auger shaft and a bolt screwable into one each of said through holes and said receiving holes.

10. An auger type icemaker comprising:

a refrigerated casing;

a vertically extending auger shaft with an auger edge, rotatably supported within said refrigerated casing to scrape and guide upward ice formed on the inner surface of said refrigerated casing;

an extrusion head fitted to the upper portion of said auger shaft and provided with ice compressing passages for receiving the ice from said auger edge; and a cutter attached to said upper end of said auger shaft over said extrusion head so as to rotate in a horizontal plane about said axis of rotation for breaking the ice from the ice compressing passages;

said cutter including a cutter edge supporting portion, and a plurality of cutter edges spaced around said axis of rotation fixed to said cutter edge supporting portion at the periphery thereof, said plurality of cutter edges being inclined with respect to said plane;

the upper end of said auger shaft and said cutter edge supporting portion including cooperating means for positioning said cutter at any of a plurality of angular positions with respect to said axis of rotation so as to adjustably position said plurality of cutter edges in relation to said auger edge, said positioning means including at least one hole formed in one of said upper end of said auger shaft and said cutter edge supporting portion, and an elongated member fittable in said at least one hole, located on the other of said upper end of said auger shaft and said cutter edge supporting portion.

11. An icemaker as in claim 10, wherein said at least one hole comprises a plurality of holes spaced about said axis in said cutter edge supporting portion.

12. An auger type icemaker comprising:

a refrigerated casing;

a vertically extending auger shaft with an auger edge, rotatably supported within said refrigerated casing to scrape and guide upward ice formed on the inner surface of said refrigerated casing;

an extrusion head fitted to the upper portion of said auger shaft and provided with ice compressing passages for receiving the ice from said auger edge; and a cutter attached to said upper end of said auger shaft over said extrusion head so as to rotate in a horizontal plane about said axis of rotation for breaking the ice from the ice compressing passages;

said cutter including a cutter edge supporting portion, and a plurality of cutter edges spaced around said axis of rotation fixed to said cutter edge supporting portion at the periphery thereof, said plurality of cutter edges being inclined with respect to said plane;

the upper end of said auger shaft and said cutter edge supporting portion including cooperating means for positioning said cutter at any of a plurality of angular positions with respect to said axis of rotation so as to adjustably position said plurality of cutter edges in relation to said auger edge, said positioning means including a plurality of through holes formed through said cutter edge supporting portion, a plurality of receiving holes formed in said upper end of said auger shaft and a bolt screwable into one each of said through holes and said receiving holes.

13. An icemaker as in claim 4 wherein said cutter edges comprise eight edges wherein four of said eight cutter edges have an angle of relief of about 30° and the remaining four of said eight cutter edges have an angle of relief of about 0°.

14. An auger type icemaker comprising:

a refrigerated casing;

a vertically extending auger shaft with an auger edge, rotatably supported within said refrigerated casing to scrape and guide upward ice formed on the inner surface of said refrigerated casing;

an extrusion head fitted to the upper portion of said auger shaft and provided with ice compressing passages for receiving the ice from said auger edge; and a cutter attached to said upper end of said auger shaft over said extrusion head so as to rotate in a horizontal plane about said axis of rotation for breaking the ice from the ice compressing passages;

said cutter including a cutter edge supporting portion, and a plurality of cutter edges spaced around said axis of rotation fixed to said cutter edge supporting portion at the periphery thereof, said plurality of cutter edges being inclined with respect to said plane, said plurality of cutter edges having differing angles of relief at the lower ends thereof;

the upper end of said auger shaft and said cutter edge supporting portion including cooperating means for positioning said cutter at any of a plurality of angular positions with respect to said axis of rotation so as to adjustably position said plurality of cutter edges in relation to said auger edge.

15. An icemaker as in claim 14, wherein said cutter edges are inclined at 60° in relation to said horizontal plane.

16. An icemaker as in claim 14, wherein said cutter edges are inclined at 60° in relation to said horizontal plane.

17. An icemaker as in claim 16, wherein said cutter edges comprise eight edges, four of said eight cutter edges having an angle of relief of about 30° and the remaining four of said eight cutter edges having an angle of relief of about 0°.

18. An icemaker as in claim 14, wherein said angle of relief is about 15°.

19. An icemaker as in claim 14, wherein said cutter edges comprise eight cutter edges, four of said eight cutter edges having an angle of relief of about 30° and the remaining four of said eight cutter edges having an angle of relief of about 0°.

* * * * *